US005897462A

United States Patent [19]

St. Germain

[11] Patent Number: 5,897,462

[45] Date of Patent: Apr. 27, 1999

[54] EXERCISE APPARATUS

[76] Inventor: Robert J. St. Germain, 44 Gorman St., Naugatuck, Conn. 06770

[21] Appl. No.: 08/839,908

[22] Filed: Apr. 18, 1997

[51] Int. Cl.[6] ..... A63B 69/06

[52] U.S. Cl. ..... 482/66; 482/130; 297/18; 297/270.1

[58] Field of Search ..... 297/18, 265.1, 297/259.4, 440.11, 270.1, 270.4; 482/130, 142, 66

[56] References Cited

U.S. PATENT DOCUMENTS

| | | | |
|---|---|---|---|
| Re. 27,255 | 12/1971 | Pierson | 297/259.4 |
| 91,832 | 6/1869 | Edson | 297/265.1 |
| 1,875,478 | 9/1932 | Miles | 297/18 |
| 2,289,031 | 7/1942 | Moeller | 297/18 |
| 4,544,200 | 10/1985 | Dunn et al. | 297/265.1 |
| 5,722,917 | 3/1998 | Olschansky et al. | 482/130 |
| 5,738,409 | 4/1998 | Bursik | 297/265.1 |

OTHER PUBLICATIONS

297–265.1 Schrams complete specification GB 0010715A S/1904.

297/265 Moores complete specification GB 0004074.

482/130 Garcia 496740 GB complete spec.

*Primary Examiner*—Jerome Donnolly

*Attorney, Agent, or Firm*—Dallett Hoopes

[57] ABSTRACT

A tubular-frame rocking platform is provided with a wheeled platform. To the structure a resistance rod is selectively locked in a forward part of the chair and extends rearwardly through a rearward element of the chair and is provided with a spring and head. When the occupant pushes back to rock the chair backwards, he does so against the opposition of the spring. This done repeatedly has therapeutic value.

11 Claims, 5 Drawing Sheets

FIG. 1
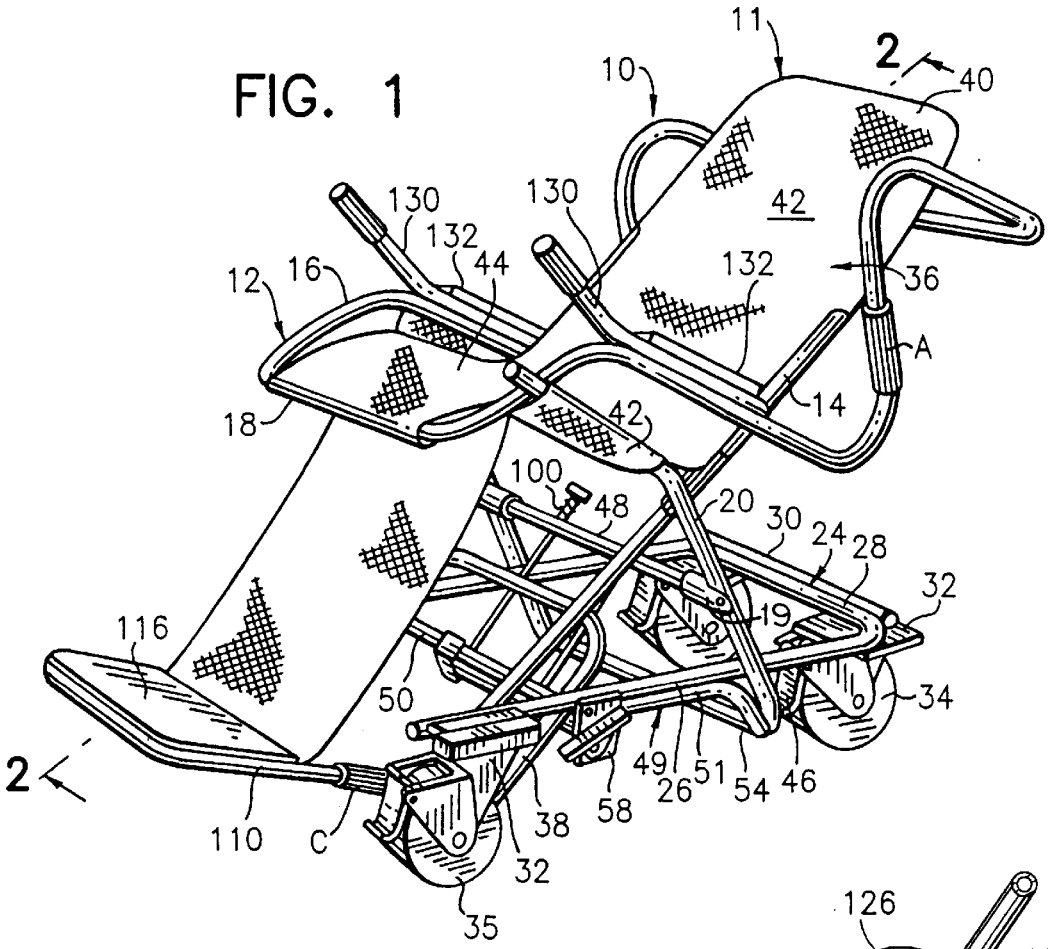
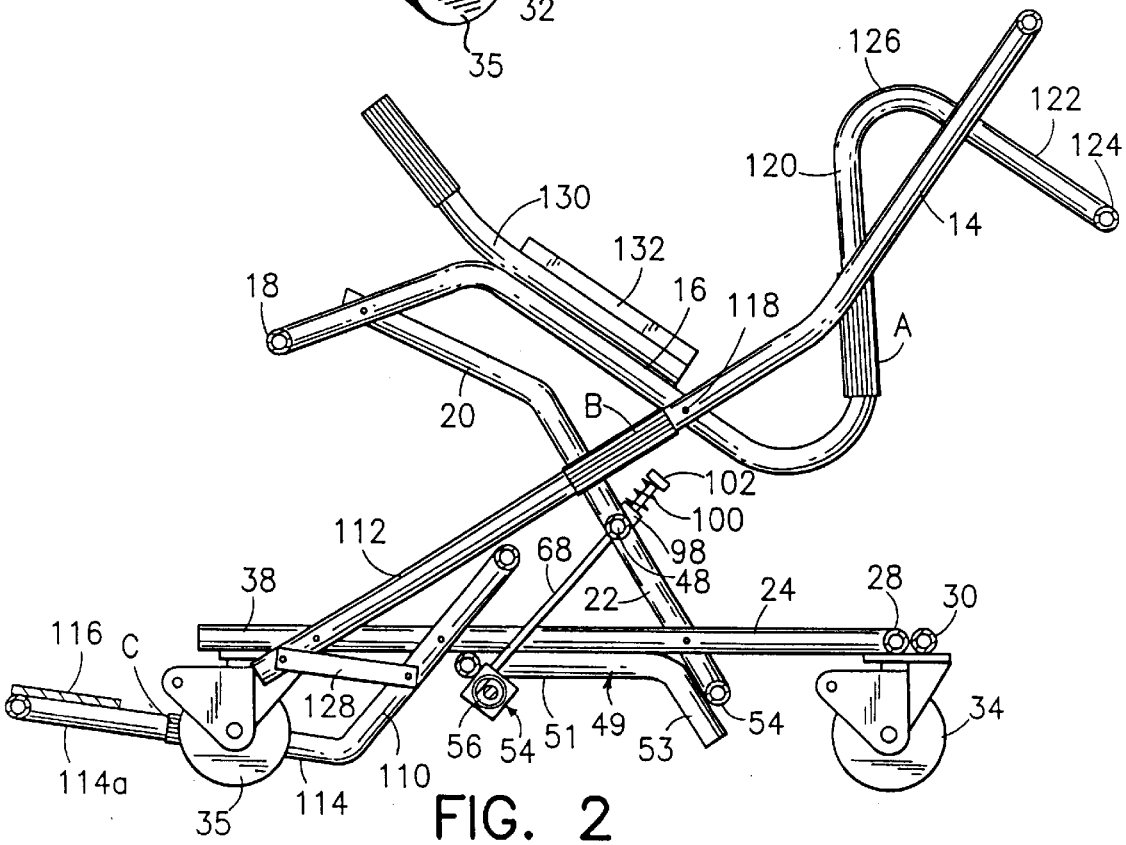
FIG. 2

FIG.9
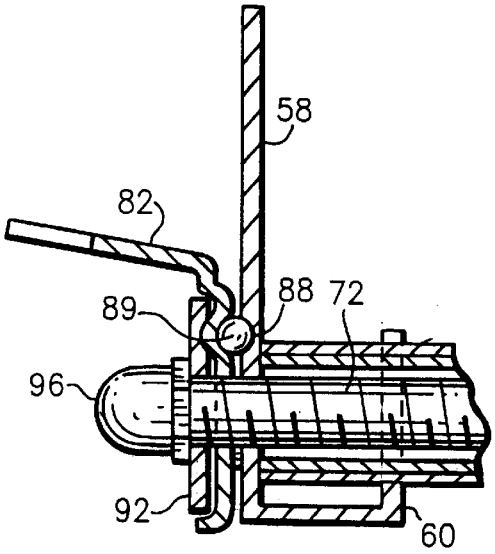
FIG.10
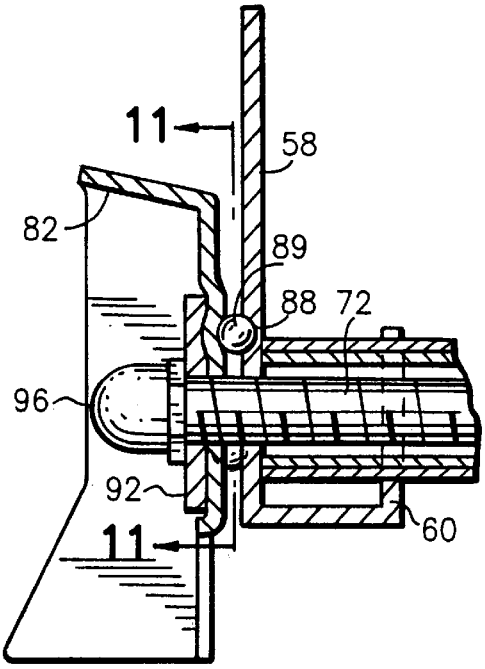
FIG.12
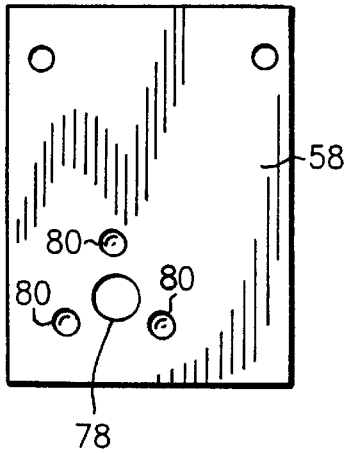
FIG.11
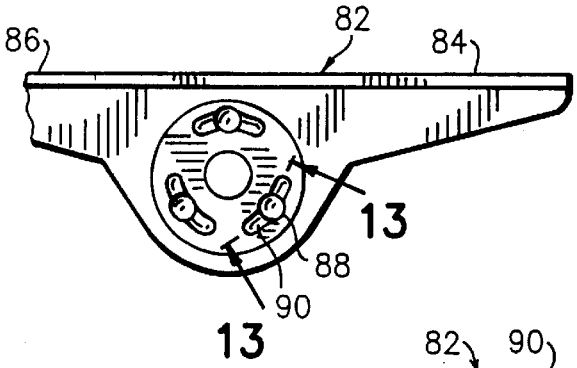
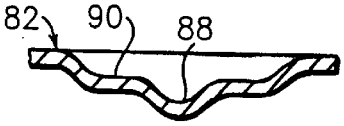
FIG.13

EXERCISE APPARATUS

FIELD OF THE INVENTION

This invention relates to an exercise apparatus. More specifically, the invention relates to an exercise apparatus comprising a rockable chair having means to resist rocking in one direction in order that the occupant must exert muscular effort to produce the rocking. Such effort has therapeutic value.

BACKGROUND OF THE INVENTION

It is so widely recognized as to be a truism that repeatedly using muscular effort will forestall the loss of or restore muscular strength. Physical therapy is partly based on this truism. Thus, physically challenged patients are encouraged to exercise the portions of their muscle structure which have become incapacitated through injury or stroke.

In the case of invalids having limited strength or control in their lower limbs, the use of rocking chairs has been found of benefit. If resistance is added to the rocking of a rocking chair, it stands to reason that the victim will benefit even further.

SUMMARY OF THE INVENTION

The present invention may be regarded as an improvement on the a rocking chair disclosed in my U.S. Pat. No. 5,476,308 issued Dec. 19, 1995, a patent hereby incorporated hereinto by reference. To it I add wheel assemblies to make it mobile and useful as a wheelchair. More than that, under the present invention I translate it into a more useful therapeutic device by providing resistance to the rearward rocking. I also provide a footrest and means by which the entire structure may be collapsed to such a size that it will fit into an automobile trunk. Lateral wings and a pushbar are also provided. The wings prevent a patient from sliding laterally out of the chair.

Under the present invention a tubular-frame rocking chair is provided with a wheeled platform. To the structure of the chair is provided a resistance rod which is selectively locked in a forward part of the chair and extends rearwardly through a rearward element of the chair and is provided with a spring and head whereby, when the occupant pushes back to rock the chair backwards, he does so against the opposition of the spring. This done repeatedly requires a cyclical application of muscular effort having therapeutic value.

BRIEF DESCRIPTION OF THE DRAWINGS

Further objects and features of the invention will be clear to those skilled in the art from a review of the following specification and drawings, all of which present a non-limiting form of the invention. In the drawings:

FIG. 1 is a perspective view of an exercise apparatus embodying the invention showing the chair part rocked into its backward end of travel;

FIG. 2 is a sectional view taken on the line 2—2 of FIG. 1 with fabric removed;

FIG. 9 is an enlarged fragmentary sectional view taken on the line 9—9 in FIG. 6;

FIG. 10 is an enlarged fragmentary sectional view taken on the line 10—10 of FIG. 7;

FIG. 11 is a sectional view taken on the line 11—11 of FIG. 10;

FIG. 12 is a front view of the resistance rod lock bracket;

FIG. 13 is a greatly enlarged view taken on the line 13—13 of FIG. 11.

DESCRIPTION OF THE PREFERRED EMBODIMENT

Figure 3:
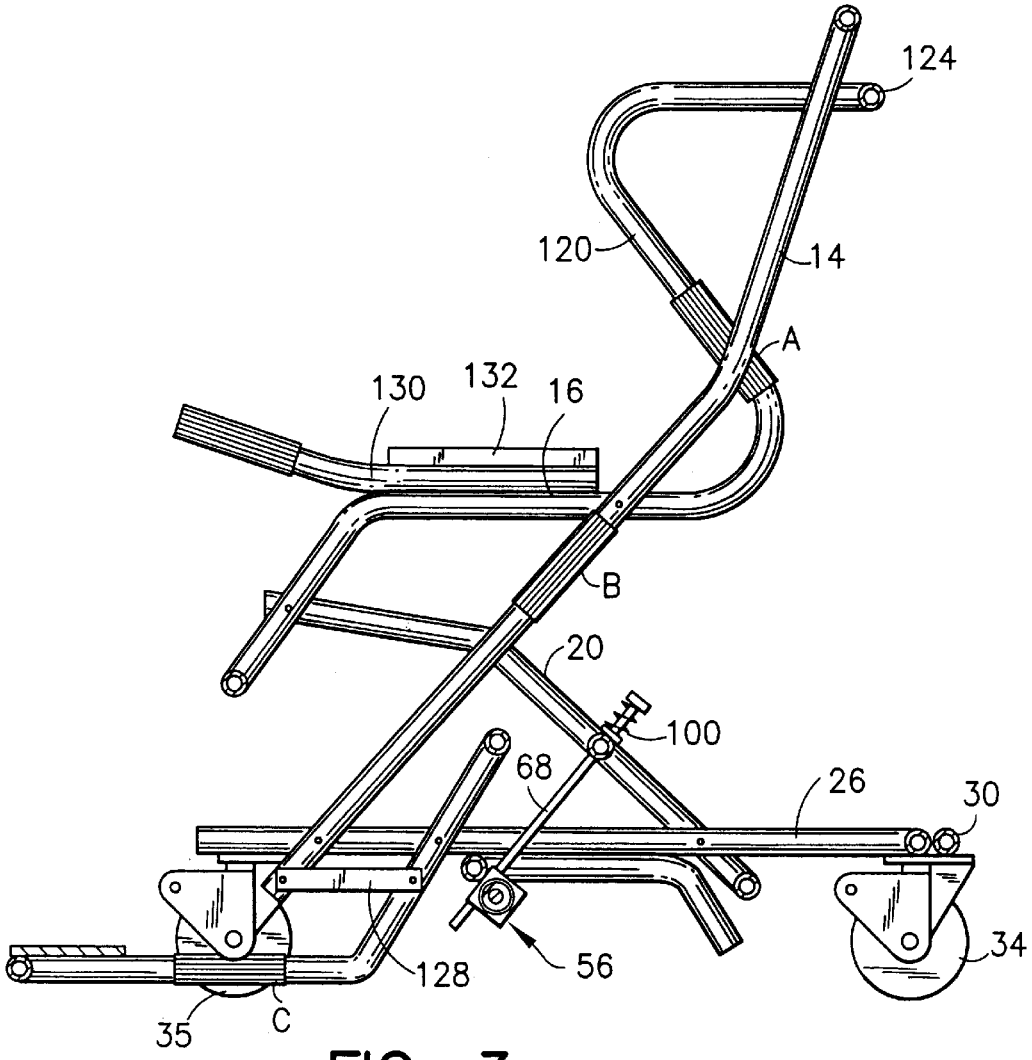
FIG. 3 is similar to FIG. 2 with the chair portion rocked to a forward position of travel.

An exercise apparatus embodying the invention is shown in FIG. 1 and generally designated 10. It generally comprises a chair 11 as disclosed in the above-mentioned U.S. Pat. No. 5,476,308. The chair 11 comprises a tubular frame 12 including a single generally inverted-U-shaped tubular back element 14. Element 14 serves as both the back support at its upper end and the forward legs at its forward lower end.

An arm rest element 16 is U-shaped and bent downward at a forward location comprises the arms of the chair and the forward cross-piece 18. At the rearward end of the arms the arm rest element 16 is pivotally attached respectively to the sides of the back element 14. A rear leg U-shaped element 20 comprises rear legs and side elements 22 having forward ends disposed at a level above the cross-piece 18. The rear leg element 20 is bent in a rearward location as shown.

A horizontal stabilizing base 24 (FIG. 2) is also U-shaped and includes parallel stabilizers 26 and a rear bight 28. The stabilizers have pivoted thereto along the lengths thereof the front and rear legs (of elements 14 and 20) on opposite sides of the chair respectively to keep the lower portion of the two sets of legs appropriately spaced.

The chair 11 further comprises a fabric strip or sling 36. The upper rearward portion of the sling 36 has a coextensive back panel (not shown) secured thereto at its top and sides to define a pocket 40 which receives the top of the tubular back element 14. The sling extends downward to constitute a back-supporting portion 42 and a seat-supporting portion 44. The forward lower end of the sling loops around the forward cross-piece 18 and is doubled back under the seat portion 44 in a tail 46 (not shown, but disclosed in patent '308) and secured to the seat portion 44.

Also disclosed in patent '308 an elongate seat-reinforcing web 52 of fabric is provided separate from the sling 36.

Figure 14:
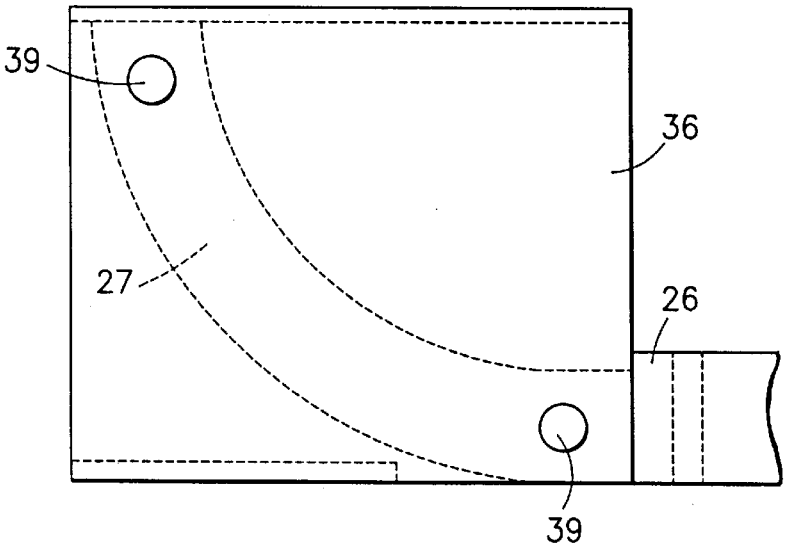
FIG. 14 is a top view of one of the support blocks at the front end of the stabilizer.

The stabilizing base 24 is provided with a reenforcing element 30 fixedly secured to the bight 26 and on a horizontal plane therewith. These two elements, the bight 26 and reenforcing element 30, as well as a portion of the side stabilizers 26 thereadjacent form a corner structure to which is secured the mounting plate 32 of a swivel wheel assembly 34. The forward ends of the two side stabilizers 26 have outwardly curved sections 27 (FIG. 14) and are each received into the mouth of an open-ended box 38 which is bolted by bolts 39 through the top and bottom walls of the box 38 and mounting plate 32 of a fixed wheel assembly 35. The top of the box 38 may serve as a platform for supporting accoutrements to the chair. The assemblies 34, 35 on each of the four corners of the stabilizing base 24 are commercially available units and may include a brake feature 46 well known in the art. By virtue of the structure thus described, the chair 11 is mounted on wheels so as to be mobile.

Extending between the side elements 22 of the rear leg element 22 is a horizontal brace 48 or cross element secured to the side elements respectively by straddling yokes 19.

A U-shaped lock-support element 49 (FIGS. 1, 2) includes a bight 50 which bridges across between the stabilizer side elements 26 to the underside of which its legs 51 are attached. As shown, the legs 51 may be deflected downward at 53 to comprise a stop element for the rearward rocking of the chair as the bight 54 of the U-shaped arm element 16 contacts it in pivoting.

Figure 8:
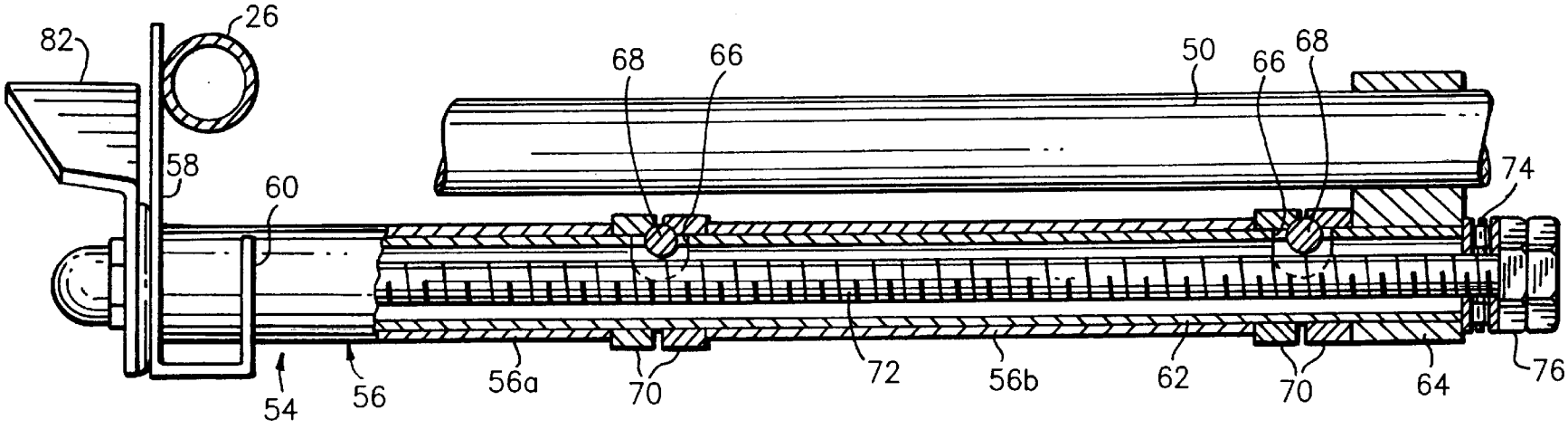
FIG. 8 is an enlarged view taken on the line 8—8 of FIG. 6 showing the locked resistance rod partly in section.

A resistance rod assembly is generally designated 54 in FIG. 2. It comprises a lock 56 which is a cross element and generally tubular. At its outer end the tubular lock 56 is supported on a plate 58 which is secured to and extends down from the side stabilizer 26 (FIG. 8). The plate 58 as shown may be J-shaped and include an upward arm 60 to cradle the tubular lock 56. As shown in FIG. 8, the tubular lock 56 is segmented as at 56*a* and 56*b*. These segments ride on an inner barrel 62. The inner end of the barrel 62 is firmly supported on a fitting 64 through which the barrel enters. The barrel 62 ends short of the end of the fitting. The fitting 64 extends upward and slidably encircles the bight 50 of the lock support 49.

In more detail, the barrel 62 of the lock is notched as at 66 and receives in the notches the resistance rods 68 perpendicular to the tubular locking element 56. Disposed about the barrel between the segments 56*a* and 56*b* of the tubular lock are pairs of annular shoes 70 which flank respectively the resistance rods 68 as shown.

Disposed axially within the tubular lock 66 is a threaded rod 72, one end of which extends out through the far end of the tubular lock and is provided with an annular bushing 74 which butts against fitting 64. The far end of the rod 72 has threaded thereon a pair of jamb nuts 76.

As shown in FIG. 9, the plate 58 is apertured as at 78 and passes the outer end of the threaded rod 72. As shown in FIG. 12, the aperture 78 is surrounded at three points by dimples 80 which are generally cup-shaped. Outward of the plate 68 the threaded rod 72 receives the foot-operated lock actuator 82 which is formed with wings 84 and 86 respectively, the wings also being provided with dimples 88 and each with lateral arcuate shallower recesses 90 contiguous therewith (FIG. 13).

An oversized washer 92 receives the threaded rod 72 outside the washer. Balls 89 ride normally in the dimples 80, 88. A cap nut 96 is tightened onto the threaded rod 72 to complete the assembly.

Turning again to the lock structure, the resistance rods 68 extend upward through openings in the horizontal brace 48 (FIG. 2). On the far side the rods are each provided with a washer 98, a spring 100, and head 102.

By virtue of the structure described, when a wing 84, 86 of the actuator 82 is turned so that the balls in dimples 80, 88 ride up the grade into shallower recesses 90, the threaded rod 72 pulls the bushing 74 against the fitting 64 to compress the segments 56*a*, 56*b* of the tubular lock against plate 58. As noted, the barrel 62 ends short of the fitting 64 so that its end does not impede the inward movement of the bushing 74. This compression of the segments 56*a* and 56*b* squeezes the shoes 66 against their partners and clamps the rods 68 therebetween locking the position of the rods 68 with respect to the lock and fixing the position of the head 102.

Figure 6:
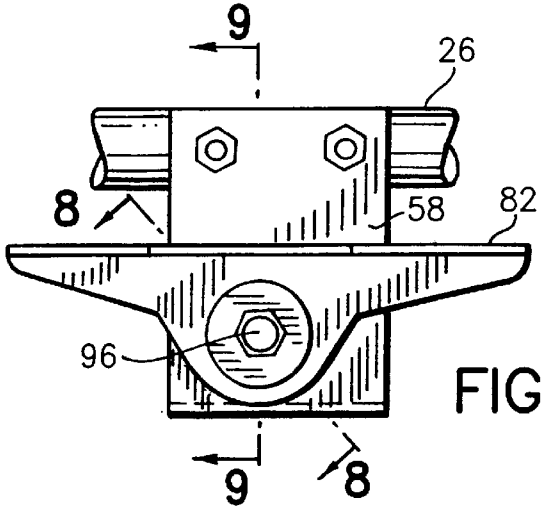
FIG. 6 is an enlarged fragmentary view showing the actuator for the resistance rod in "off" position.

Thus, as the chair is rocked rearwardly thereafter, the brace 48 compresses the spring 100 against the fixed head 102 to add resistance to the rocking. The spring 100 may be selected of a strength to achieve the desired resistance. Such resistance has a therapeutic effect on the legs of the occupant when done repeatedly. When it is desired to rock the chair normally without resistance, the actuator 82 is turned into the central position (FIG. 6) allowing the balls 89 to move into the deeper dimples 80, 88 releasing the tension on the threaded rod 72. This slackens the grip of the annular shoes 70 allowing the resistance rods 68 to reciprocate easily in the locking device 56.

It is envisioned that the rocking of the chair may be motorized for patients who may be too feeble to rock themselves but who would enjoy the rocking motion and benefit from whatever therapy such rocking gives. In such an arrangement a speed-reduced motor may be mounted on one of the resistance rods 68 and equipped with an eccentric drive or crank arm which would bear against the horizontal brace 48 near where the rod passes through the brace. The motor can be speed-controlled. With the resistance rods 68 locked, the cyclical pushing of the eccentric drive or crank arm rocks the rocker.

To provide a foot platform for the occupant, the apparatus includes an inverted U-shaped element 110, the sides 112 of which are pivoted to the respective side stabilizers 26 adjacent their distal ends and they are deflected forwardly in runs 114 and 114*a*. Across the two runs 114*a* a footrest 116 is provided to support the feet of the occupant. It is against this platform 116 that the patient pushes with his feet to rock the chair 110. A fabric guard sheet 117 (FIG. 1) runs down from the underside of the sling 36 to the footrest 116. It serves to keep the patient's feet from intruding into the area of the moving parts of the chair. The guard sheet may be attached to the sling 36 by Velcro.

The arm U-shaped element 16 has extending the wing patient-retainer structure which extends rearward from the pivotal connection 118 with the back 14 and then loops forward (FIG. 2) and upward section at 120 and then extends rearward to a section 122 into a bight 124 behind the back 40 in a pushbar as when using it as a wheelchair. There is thus provided lateral wings 126 to engage the shoulders of the occupant in the event that the occupant tends to slump to one side or the other.

As shown, the rearward run of the lateral wings may actually be continuations of the side elements 17 of the arm element 16. Attached to the side elements of the arm element 16 there may also be a forward tubular element comprising a gripping handle 130 to give additional therapeutic resistance to the occupant if desired or necessary as well as a help to aid in getting out of the chair. A molded arm rest 132 with soft rubber to avoid any abrasive action to those patients with sensitive skin may be added above the rearward end of the handgrip 130.

Figure 4:
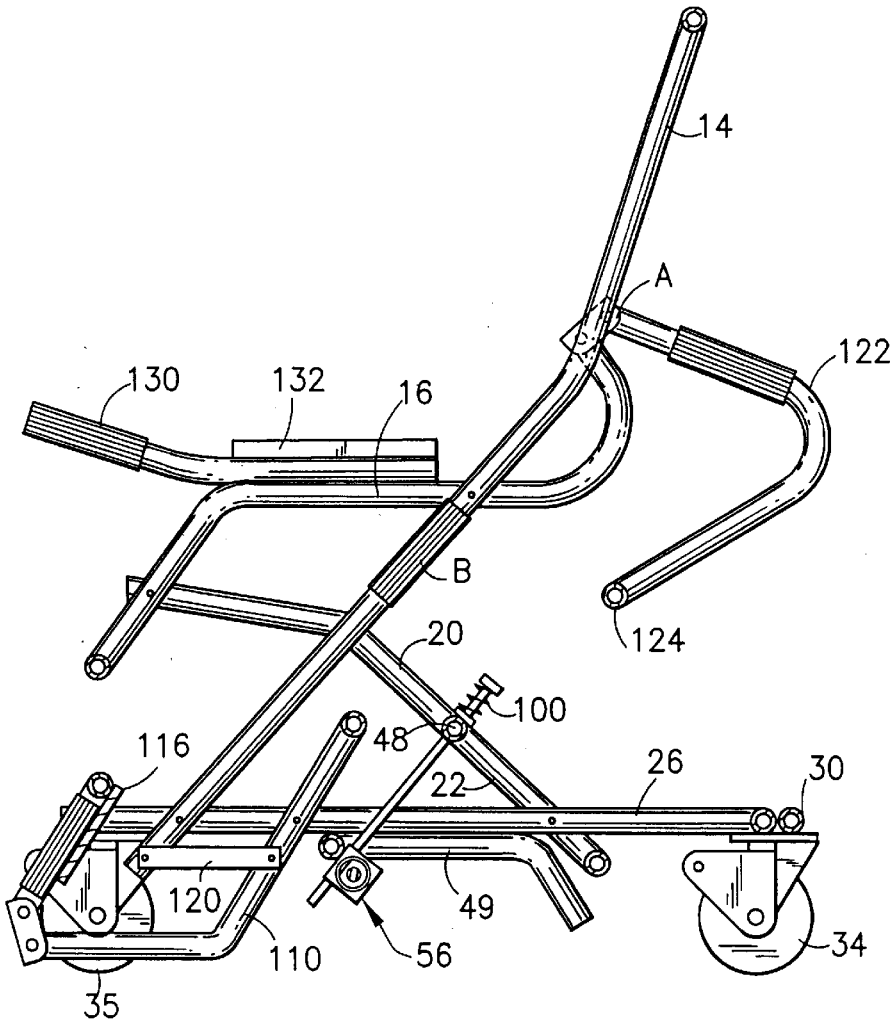
FIG. 4 is similar to FIG. 3 but showing the lateral wing support and the foot platform partly collapsed.
Figure 5:
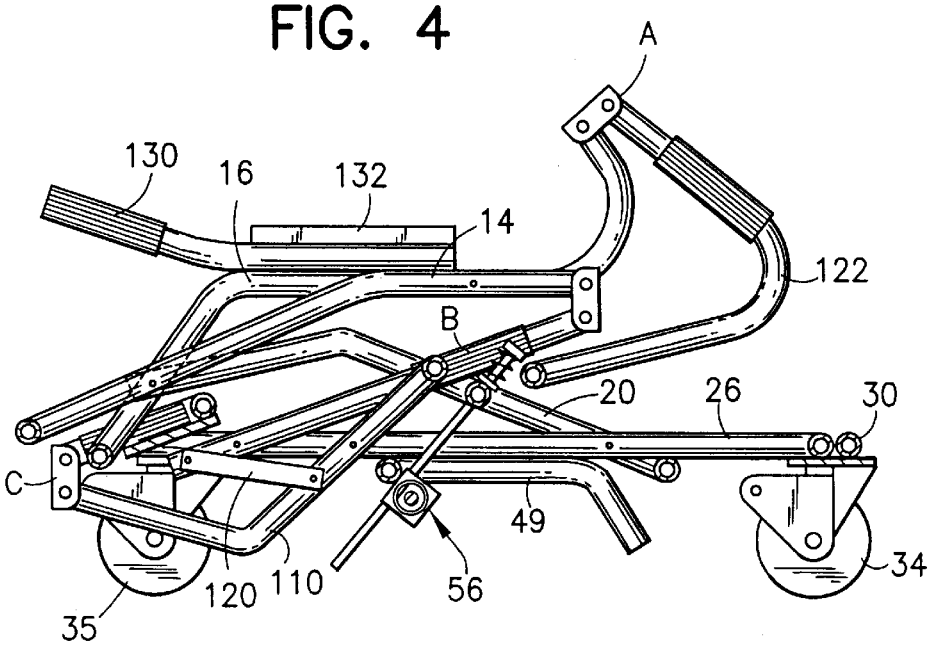
FIG. 5 is a view similar to FIG. 4 but showing the chair assembly fully collapsed.
Figure 7:
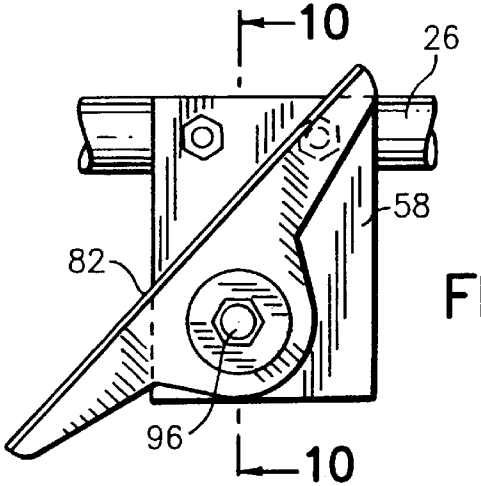
FIG. 7 is a view similar to FIG. 6 showing the actuator in "on" position.

As described, the exercise apparatus of the invention in the preferred embodiment is collapsible. This is made possible by a number of hinges of the type described in my U.S. Pat. No. 5,577,799 issued Nov. 26, 1996 and incorporated herein by reference. Tubular elements in such a hinge are interrupted and provided in the end of each element with a plug having axial extending eyes, the eyes being joined by U-shaped knuckles, the entire structure being selectively covered by a supporting sleeve. Thus, as shown in the progressive FIGS. 1 through 5, such hinges are located at A, B and C and may be broken, that is, the sleeve may be moved axially of the tubular element and the hinges folded to assist in the collapsing as shown fully done in FIG. 5. The hinge C may be folded as shown at FIG. 4 by an attendant to make it easier for the patient to exit the chair.

A link 128 may be provided between the lower end of the back unit and the side of the U-shaped footrest (FIGS. 4, 5) so that when the chair is rocked, the footrest 116 automatically raises to make it more accessible to the feet of the rocker, and at a more helpful angle.

The comfort of the chair may be tailored to a given patient by adjusting the fabric sling 36 and the support 42 to size. Additionally, to avoid contact of the fabric with the sensitive skin of some patients, the use of a one-piece seat and back cushion may enhance comfort.

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. An exercise apparatus comprising:

a. a rocking chair defined by:

1) an elongate upright tubular back unit having parallel long sides and an upper connecting bight, 2) a generally U-shaped arm unit having a forward bight and rearward sides, the arm unit sides pivotally attached at their distal ends to the respective long sides of the back unit adjacent the middle thereof, 3) a generally U-shaped rear unit having a rearward and downward bight and upward sides, the distal ends of the rear unit upward sides pivotally attached to the respective arm unit sides adjacent the bight of the arm unit, and 4) a pair of linear parallel stabilizers, one on each side of the chair, pivotally connected respectively along their length to the long sides of the back unit and to the rear unit, b. a resistance unit for the chair defined by:

1) a first cross element bridging perpendicularly between the sides of the rear unit in a position beneath where sides of the back unit and the side of the arm unit are most proximate, 2) a second cross element secured to at least one of the stabilizers and extending perpendicular thereto toward the other stabilizer, 3) at least one rigid adjustable resistance rod attached to and extending from the first cross element to the second cross element, and 4) resilient means associated with the resistance rod offering resistance to movement of the cross elements away from each other.

2. An exercise apparatus as claimed in claim 1 wherein one of the attachments of the rigid rod to a cross element includes releasable lock means.

3. An exercise apparatus as claimed in claim 2 wherein the releasable means is a screw-driven lock operable to lock the resistance rod to a cross element.

4. An exercise apparatus as claimed in claim 1 wherein the stabilizing elements extend beyond their attachments to the back unit and arm unit and wheels are provided on the extensions.

5. An exercise apparatus as claimed in claim 4 wherein the stabilizing elements extend rearward and are joined by a connecting bight.

6. An exercise apparatus as claimed in claim 1 wherein a U-shaped footrest element is connected by its sides to the respective stabilizers.

7. An exercise apparatus as claimed in claim 1 wherein the resilient means comprises an opening in a cross element freely receiving the resistance rod with a head on the resistance rod on one side of said brace element and a helical spring is disposed about the resistance rod inbetween the said cross element and the head.

8. An exercise apparatus as claimed in claim 7 wherein the other cross element comprises clamping means operable by a foot-operated actuator to close the clamp to secure the resistance rod relative to the other cross element.

9. An exercise apparatus as claimed in claim 8 wherein the clamping means includes a pair of tubular elements flanking the resistance rod and the foot-operated actuator turns a threaded rod to squeeze the tubular elements together causing the tubular elements to compress the resistance rod inbetween them and lock the resistance rod to the other cross element.

10. An exercise apparatus as claimed in claim 9 wherein the tubular elements are slidably supported on a coaxial barrel.

11. An exercise apparatus comprising:

a. a wheeled platform, b. a rocking chair rockably supported on the platform and rocking in a direction rearward and forward, c. a resistance rod extending between a point on the platform and a point on the chair spaced above the platform and to the rear of the point on the platform, d. means for releasably clamping the rod from opposite sides of the rod at one of the point on the platform or the point on the chair said means upon disengagement permitting the rod to move freely there between, and e. means on the rod at the other of the point on the platform or the point on the chair for resisting further movement of the point on the chair away from the point on the platform beyond a preset distance, when the means for releasably clamping the rod is engaged.

* * * * *